United States Patent [19]

Papajewski

[11] 4,138,958

[45] Feb. 13, 1979

[54] THREAD TRIMMER DRIVING MECHANISM FOR SEWING MACHINES

[75] Inventor: Reinhold Papajewski, Friedrichtal, Fed. Rep. of Germany

[73] Assignee: The Singer Company, New York, N.Y.

[21] Appl. No.: 882,698

[22] Filed: Mar. 2, 1978

[51] Int. Cl.[2] ..... D05B 65/00

[52] U.S. Cl. ..... 112/292; 112/300

[58] Field of Search ..... 112/285, 291, 292, 300

[56] References Cited

U.S. PATENT DOCUMENTS

| | | | |
|---|---|---|---|
| 3,371,633 | 3/1968 | Hedegaard | 112/292 |
| 3,599,933 | 12/1967 | Bono | 112/292 |
| 3,605,664 | 9/1971 | Hedegaard | 112/292 |
| 3,624,735 | 11/1971 | Hedegaard | 112/292 |
| 3,709,176 | 1/1973 | Papajewski | 112/292 |
| 3,776,161 | 12/1973 | Papajewski et al. | 112/292 |

*Primary Examiner*—Ronald Feldbaum

*Attorney, Agent, or Firm*—Michael H. Wallach; Robert E. Smith; Edward L. Bell

[57] ABSTRACT

A driving mechanism for actuating an underbed thread trimmer in a post-type sewing machine. The unit is selectively controlled by a solenoid and actuated by two cams located on the hook shaft of the feeding post. Rotary motion of the shaft and cams is converted into translational motion for the trimmer by a pivoting swivel lever and cam follower combination.

3 Claims, 4 Drawing Figures

THREAD TRIMMER DRIVING MECHANISM FOR SEWING MACHINES

BACKGROUND OF THE INVENTION

1. Field of the Invention

This invention relates to sewing machines in general and more particularly to post-type sewing machines having an underbed thread trimmer.

2. Description of the Prior Art

The use of solenoids or cams for actuating thread trimmers is well known in the prior art. See for example U.S. Pat. No. 3,709,176 to Papajewski et al; U.S. Pat. No. 3,658,021 to Hedegaard et al; U.S. Pat. No. 3,624,735 to Hedegaard; U.S. Pat. No. 3,371,633 to Hedegaard; and U.S. Pat. No. 3,359,933 to Bono. One problem associated with prior known driving mechanisms for underbed thread trimmers is that they are unable to provide long strokes for the trimming blade from a mechanism contained entirely within the feeding post of a post-type sewing machine. Moreover, the prior art trimmer driving mechanisms are not provided with a means for positively disengaging the mechanism to insure that the trimming function is not repeated without a subsequent command. Another problem associated with underbed thread trimmers involves timing the thread trimmer driving mechanism to coincide with an advantageous location of the rotary hook for servering the needle and bobbin threads.

SUMMARY OF THE INVENTION

An object of this invention is to provide a compact drive mechanism for an underbed thread trimmer which will fit within the confines of the feeding post of a post type sewing machine.

It is also an object of this invention to provide a drive mechanism in which the operation of the mechanism is initiated by the use of a solenid but does not depend on the solenoid to provide the driving power.

Another object is to adapt a series of cams which are driven by the rotary hook shaft to supply the power required to operate the driving mechanism.

An additional object of this invention is to provide a driving mechanism for a thread trimmer in which the timing of the initiation or completion of the driving cycle relative to the location of the rotary hook with respect to the needle and hook threads may be adjustably controlled.

Another object of the invention is to provide a positive mechanical means for terminating the driving function without the need to rely on a solenoid to terminate the function.

The disclosed objects and other advantages of this invention are obtained by an arrangement of rotary cams attached to the rotary hook shaft of a sewing machine. The cams are attached to the hook shaft so that one of them may be selectively engaged by a movable follower pin under the control of a solenoid. The solenoid initiates operation of the drive mechanism by forcing a cam follower pin to engage the track contained on the face of a rotary cam. The cam follower pin is attached to a swivel lever which pivots in response to the movement of the cam follower coacting with the cam. A driving member is attached to the swivel lever to transfer the pivotal motion of the swivel lever to an underbed thread trimmer mechanism. The driving mechanism is restored to its initial position by a second cam and cam follower combination which are driven by the rotary hook shaft after completion of the trimming operation. The driving mechanism of this invention is adapted to be accommodated entirely within the feeding post of a post-type sewing machine.

BRIEF DESCRIPTION OF THE DRAWINGS

The above and other objects of this invention will be evident from an understanding of the preferred embodiment which is hereinafter set forth in such detail as to enable those skilled in the art readily to understand the function, operation, construction, and advantages of it when read in conjunction with the accompanying drawings in which.

DESCRIPTION OF THE PREFERRED EMBODIMENT

Figure 1:
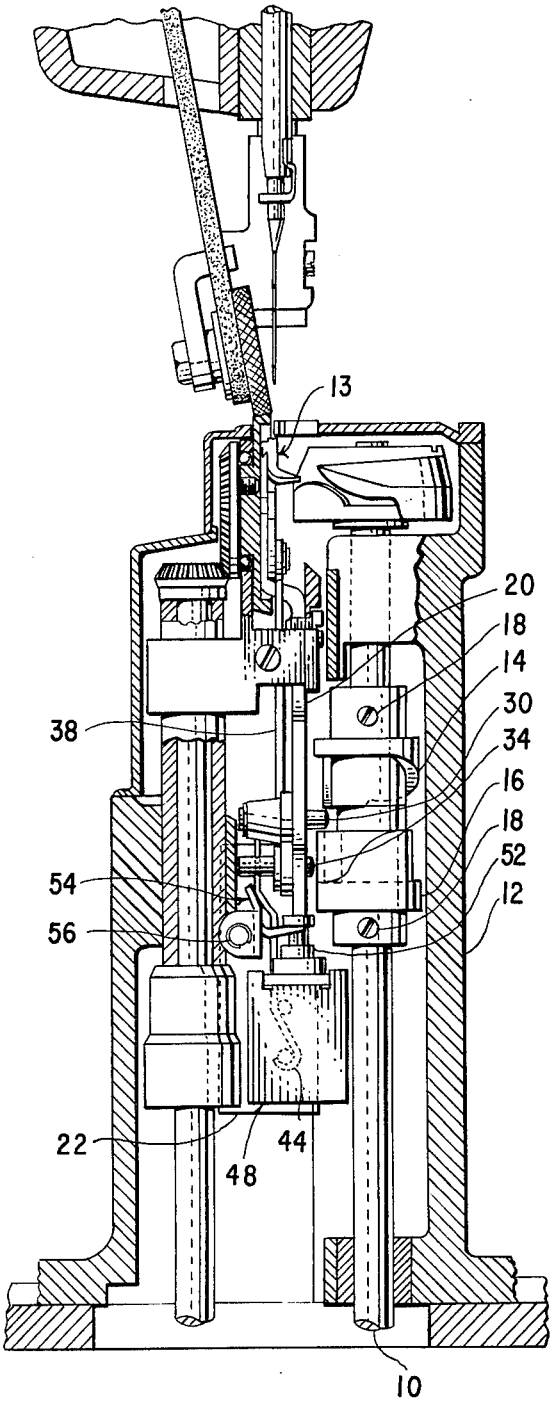
FIG. 1 is a sectional view of a portion of a post type sewing machine having a driving mechanism constructed in accordance with the principles of the present invention.

Referring to FIG. 1 of the drawings, 12 indicates a feeding post of a post type sewing machine having a thread trimmer 13 to which the driving mechanism of this invention may be applied. A thread trimmer of the type which may be driven in a conventional manner by the disclosed mechanism is illustrated in U.S. Pat. No. 3,709,176 of Jan. 9, 1973 to Papajewski et al. Indicated at 10 is a rotary shaft to which are fixedly attached an upper cam 14 and lower cam 16 with conventional fastening means 18, such that upon rotation of the shaft 10 the upper cam 14 and lower cam 16 also rotate. Within the feeding post 12 and rigidly mounted parallel to rotary shaft 10 is a bracket 20 to which is fixedly attached a cylindrical bearing pin 26, preferably extending normal to the surface of bracket 20 and in a direction away from the rotary shaft 10. The bracket 20 has a bracket extension 22 formed at the lower portion of and extending normal to the bracket 20 and in a direction away from the rotary shaft 10. a cylindrical mounting shaft 56 is fixedly attached to and may extend normal to the bracket extension 22 and in a direction parallel to the first bracket 20. For reasons which will become apparent, a solenoid 48 having a plunger 52 which contains an annular groove 50 about its circumference is mounted on bracket extension 22 with the plunger operable in a vertical direction parallel to the rotary shaft 10.

Figure 4:
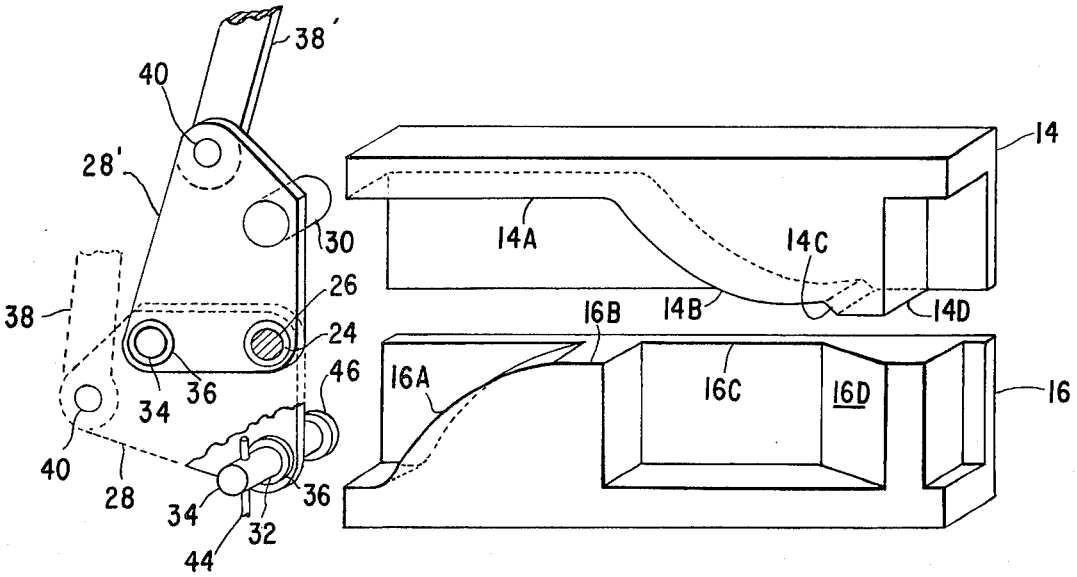
FIG. 4 is a flat layout of the faces of the two cams showing the two positions that the swivel lever assumes when the two follower pins cooperate with the cams.

As illustrated in FIG. 4, journalled on the pin 26 is a swivel lever 28 having a cylindrical fixed follower pin 30 rigidly attached thereto and a shoulder 36 containing a bore 32 therethrough. Slidably received in the bore 32 is a movable follower pin 34. Also illustrated is a bearing journal 24 for rotatably receiving the bearing pin 26. Fixedly attached to the swivel lever 28 is a cylindrical pin 40 on which a driving member 38 is pivotally journalled.

Figure 3:
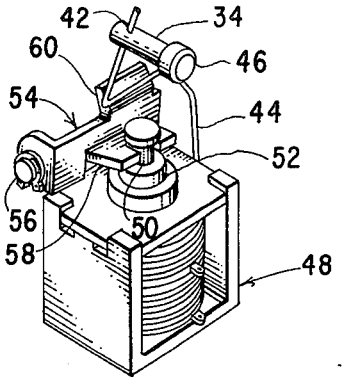
FIG. 3 is a perspective view of the solenoid and movable follower which cooperate to engage the cams shown in FIG. 2.

FIG. 3 shows a bore 42 in movable follower pin 34. The bore is contained normal to the axis of the movable follower pin 34 and is placed slidably receive a spring 44. The movable follower pin 34 has a cylindrical head 46 which is larger in diameter than the diameter of bore 32 and which is disposed at the end opposite that which contains bore 42, whereby the head prevents the movable follower pin from passing through bore 32.

FIG. 3 also shows a tripping pawl 54 which is rotatably mounted on mounting shaft 56. The tripping pawl has a bifurcated arm 58 extending normal to the body of the tripping pawl 54 for slidably engaging an annular groove 50 in solenoid plunger 52. The body of the tripping pawl has an extension tab 60 which extends upwardly and toward the back of the tripping pawl. The spring 44 is fixedly attached to the body of solenoid 48 and is slidably received in the bore 42 in the movable follower pin 34. The spring 44 is so shaped to rest against extension tab 60 of the tripping pawl and to bias movable follower pin 34 whereby head 46 of the movable follower pin is normally drawn into contact with swivel lever 28 and away from contact with lower cam 16.

Figure 2:
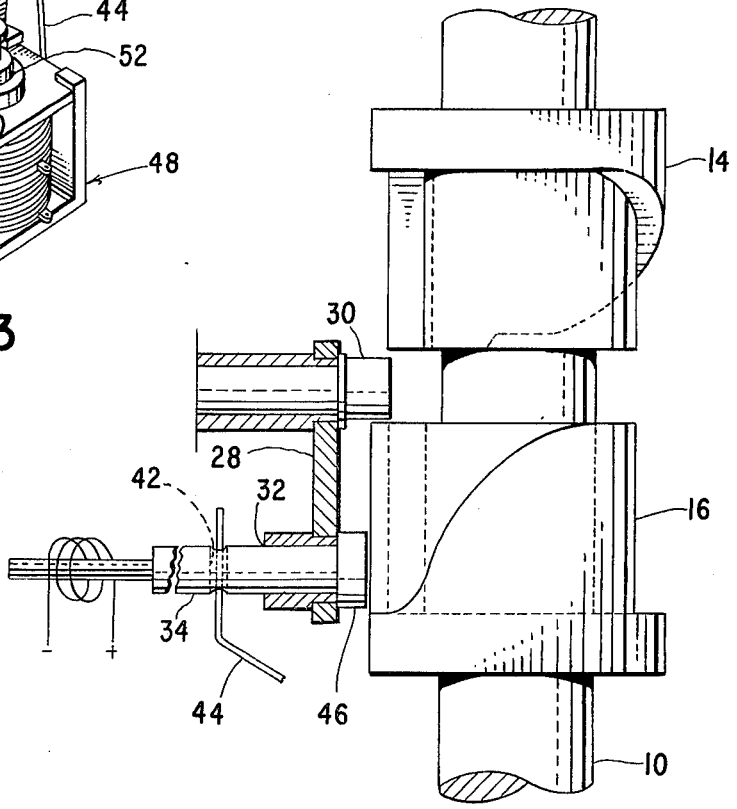
FIG. 2 is an elevational view partly in section of the cams and followers which cooperate to effectuate the objects of this invention.

As illustrated in FIG. 2, cam 14 is disposed above cam 16 on rotary shaft 10 and in spaced relation to the second cam whereby fixed follower pin 30 may freely enter the space between the two cams. Swivel lever 28 is so disposed in spaced relation to cam 16 to allow head 46 of movable follower pin 34 to remain in clearance of the cam 16 during rotation of the cam 16 until urged against the cam 16 by the spring 44. The movable follower pin 34 is urged against the cam 16 by the coaction of solenoid 48 and tripping pawl 54 forwardly biasing against the pressure of spring 44.

FIG. 4 shows a flat layout of the faces of cams 14 and 16 and the cooperating parts of swivel lever 28. The face of cam 14 selectively coacts with fixed follower pin 30 and the face of cam 16 selectively coacts with the movable follower pin 34. FIG. 4 also shows the position of swivel lever 28 prior to operation of the driving mechanism as position 28 (shown in phantom) and the position of swivel lever 28 after being driven to its extended position as shown at 28'.

Operation of the driving mechanism commences with swivel lever 28 in the rest position shown in phantom on FIG. 4, and with head 46 of movable follower pin 34 retracted toward swivel lever 28 and in clearance of the rotation of cam 16. Actuation of solenoid 48 causes solenoid plunger 52 to retract downwardly into the body of the solenoid 48. The retraction of solenoid plunger 52 produces an arc rotary motion of tripping pawl 54 through the urging downward of birfurcated arm 58 of the tripping pawl 54. The arc rotary motion of the tripping pawl 54 urges extension tab 60 of the tripping pawl against the spring 44. The movable follower pin 34 is urged to axially translate toward cam 16 by the force imparted through the spring 44 by the solenoid 48. The movable follower pin 34 translates through bore 32 in swivel lever 28 until head 46 of the movable follower pin 34 contacts the track contained on the face of cam 16. The movable follower pin head 46 engages the inclined ramp segment 16A of cam 16. Rotation of cam 16 causes the head to translate along the surface of ramp segment 16A. The translation causes swivel lever 28 to pivot about cylindrical bearing pin 26 until the swivel lever assumes position 28' shown in phantom on FIG. 4, at which time the head 46 of the movable follower pin 34 is at surface 16B of cam 16. The rotation of swivel lever 28 causes the driving member 38 which is pivotally journalled to the swivel lever 28 by driving member pin 40 to translate to position 38', to drive the trimmer 13, thereby effectuating the objects of this invention.

The upper cam 14 is so adjusted in timed relation to lower cam 16 such that when the head 46 of the movable follower pin 34 is located over void 16C in the track face of the lower cam 16, the fixed follower pin 30 is engaging ramp 14B of the track contained on the face of the upper cam 14. When the head 46 of the movable follower pin 34 reaches the void 16C in the track face of the lower cam 16 the head 46 is withdrawn from contact with the cam by the constant backward force imparted by spring 44 and assumes a spaced relation with the lower cam 16. The continued rotation of the rotary shaft 10 causes the upper cam 14 to contact the fixed follower pin 14 along ramp 14B on the track face of the upper cam 14 and to force the swivel lever 28 to pivot backwardly to its initial position prior to actuation of the driving mechanism. The fixed follower pin 30 is forced out of contact with the upper cam 14 by the inclined surface 14C and flat 14D of the track contained on the face of the upper cam 14.

The fixed follower pin 30 thereafter is located in the space between the upper cam 14 and the lower cam 16. If spring 44 fails to fully withdraw the movable follower pin 34 from contact with the track of lower cam 16, the wedge shaped surface 16D contained in the face of lower cam 16 will engage the head 46 and will axially drive it away from contact with the lower cam 16 as the lower cam 16 rotates.

It will be observed that if initiation of the operating cycle for the driving mechanism is commenced at any time other than when the head 46 of the movable follower pin 34 can be driven into contact with the track segment 16A contained on the face of lower cam 16, the head 46 will contact a solid portion of the face of lower cam 16 and will be driven away from contact with the lower cam 16 by the ramp segment 16D contained on the face of the lower cam 16, with no attendant pivotal motion of the swivel lever 28. The swivel lever 28 will not commence to pivot until the head 46 comes into contact with the surface of ramp segment 16A.

Modifications and variations of the above described preferred embodiment will become evident to one skilled in the art in light of the above teachings. It is to be understood that variations may be made to the preferred embodiment without departing from the spirit and scope of the invention as defined in the appended claims.

Having thus set forth the nature of this invention, what is claimed herein is:

1. A driving mechanism for driving a thread trimmer for a sewing machine having a rotary hook, said driving mechanism comprisng a shaft rotatably mounted in said sewing machine in fixed relation with said hook, a first cam having a face containing a track and a second cam having a face containing a track rotatably fixed to and spaced apart on said shaft, a swivel lever pivotally mounted in spaced relation to said cams for pivoting from a first position to a second position, a driving member pivotally journalled to said swivel lever and to said thread trimmer, said swivel lever containing a bore for slidably receiving a movable follower pin and further containing a fixed follower pin rigidly attached thereto, a movable cam follower pin slidably received within said bore of said swivel lever and having means for engaging said first cam track, actuating means for selectively moving said movable cam follower pin for engaging said first cam track, said first cam track being shaped so as to move said movable follower pin and said swivel lever from the first position to the second position, whereby engagement of said movable follower pin with said first cam pivots said swivel lever from said first position to said second position and moves said driving member to actuate said thread trimmer and to engage said fixed follower pin with the track on the face of said second cam, said second cam track being shaped so as to move said fixed follower pin and said swivel lever from the second position to the first position, and being disposed relative to the first cam track such that when the fixed pin engages the second track, the movable follower pin disengages from the first cam.

2. A driving mechanism as recited in claim 1 wherein said actuating means for selectively engaging said movable cam follower pin with said first cam comprises a solenoid mounted in fixed relation to said rotary shaft, a spring slidably contained in a bore in said movable cam follower pin for urging said mvable cam follower pin away from said first cam, means for drivingly connecting said solenoid with said spring, whereby actuation of said solenoid will cause said spring to urge said movable cam follower pin to slide in said bore in said swivel lever and be urged into contact with said first cam.

3. A driving mechanism as recited in claim 1 wherein said face on aid first cam contains a ramp for urging said movable cam follower pin away from contact with said first cam.

* * * * *